US005115937A

United States Patent [19]

Chausse et al.

[11] Patent Number: 5,115,937

[45] Date of Patent: May 26, 1992

[54] CONTAINER FOR STORING AND TRANSPORTING A PLURALITY OF BEVERAGE CONTAINERS

[75] Inventors: Joseph J. Chausse, Lockport; Edward A. Ebert, Snyder, both of N.Y.

[73] Assignee: Ecology Plastics Corp., Lockport, N.Y.

[21] Appl. No.: 657,640

[22] Filed: Feb. 15, 1991

[51] Int. Cl.[5] ..... B65D 21/00

[52] U.S. Cl. ..... 220/507; 220/519; 206/144; 206/203

[58] Field of Search ..... 220/507, 509, 514, 515, 220/516, 517, 519; 206/144, 503, 505, 509, 203

[56] References Cited

U.S. PATENT DOCUMENTS

| | | | |
|---|---|---|---|
| 2,535,493 | 12/1950 | Gerber | 220/516 X |
| 2,619,251 | 11/1952 | Schmidt | 220/513 |
| 2,935,222 | 5/1960 | O'Connell | 220/509 |
| 4,095,720 | 6/1978 | Delbrouck et al. | 220/519 |
| 4,266,714 | 5/1981 | Crane | 206/509 |
| 5,038,961 | 8/1991 | Watanabe et al. | 206/203 X |

*Primary Examiner*—Steven M. Pollard

*Attorney, Agent, or Firm*—Robert P. Simpson; Michael L. Dunn

[57] ABSTRACT

The invention is a container for storing and transporting a plurality of beverage containers and the like. The container includes a substantially frusto-pyramidal housing having four supporting walls and a top wall supported by the supporting walls. The container has at least one storage chamber extending downwardly from the top wall, and the supporting walls are arranged to telescopingly engage supporting walls of an identical container and each chamber nestles within a corresponding chamber of the identical container when the container is stacked upon the identical container and the identical container is empty of beverage containers. Means are provided for securing identical containers together in a stacked arrangement for easy transport.

3 Claims, 5 Drawing Sheets

49'
52'
53'
44'
48'
50'
33'
74'
10'
74
10
33
48
50
37
11
11
67'
44
61
9
52
52'
54'
54
9
32'
31'
31
39
13'
39
13

10'
14'
72
33'
50'
48'
49'
71
59'
70
53'
52'
54'
32'
18'
20'
31'
36'
21'
13'

10'
14'
39
31'
33'
49'
50'
60'
53'
52'
32'
13'
10
14
31
33
37
60
54'
32
39
13

CONTAINER FOR STORING AND TRANSPORTING A PLURALITY OF BEVERAGE CONTAINERS

BACKGROUND OF THE INVENTION

The present invention relates generally to containers for carrying a plurality of beverage containers, and, more specifically, to a lightweight, stackable container to facilitate the return of beverage containers to a supermarket or redemption center.

As of 1989, at least ten states had enacted returnable container laws, enabling consumers to return empty containers (glass, metal or plastic) to stores, vendors and redemption centers for refunds of deposits (California, Connecticut, Maine, Vermont, Oregon, Iowa, New York, Michigan, Delaware, and Massachusetts). The purpose of these laws is well-stated by the New York State Legislature:

> The legislature hereby finds that litter composed of discarded soft-drink, beer and ale bottles and cans is a growing problem of state concern and a direct threat to the health and safety of the citizens of this state. Discarded beverage bottles and cans create a hazard to vehicular traffic, a source of physical injury to pedestrians, farm animals and machinery and an unsightly accumulation of litter which must be disposed of at increasing public expense. Beverage bottles and cans also create an unnecessary addition to the state's and municipalities' already overburdened solid waste and refuse disposal systems. Unsegregated disposal of such bottles and cans creates an impediment to the efficient operation of resource recovery plants. Further, the legislature finds that the uninhibited discard of beverage containers constitutes a waste of both mineral and energy resources. The legislature hereby finds that requiring a deposit on all beverage containers, along with certain other facilitating measures, will provide a necessary incentive for the economically efficient and environmentally benign collection and recycling of such containers.

N.Y. Environmental Conservation 27-1001 (Legislative Findings)

Under a typical beverage container law, consumers pay a small deposit when purchasing beverages and get that deposit back when returning the containers. In most states at present, the deposit is no less than five cents, but in some cases may be more than five cents, per container. Usually, a consumer can return empty containers (glass, metal, or plastic) to any store or vendor that sells the same size and type of container.

As with any new law, in the beginning, it took everyone some time to grow accustomed to saving empty beverage containers and returning them for the deposit. Over time, however, the inherent environmental and economic incentives of the laws have prevailed, and it is now a common sight in those states with beverage container laws to see consumers at supermarkets, etc., bringing back their empty beverage containers for deposit refunds. In fact, the law has worked so well in New York that, at the time the application for this patent was filed, the Governor of New York had recommended to the state legislature that it expand the law to include containers for liquor, wine and fruit juice, in addition to beer and soft drinks.

As with most new laws, the beverage container laws have created some problems of their own. An obvious problem which has arisen is that of transporting the beverage containers from the home to the store. Some consumers store and transport the cans and bottles in plastic or paper grocery bags. With respect to storage, bags are not ideal because the containers tend to fall out of them when the bags are laid upon a floor. Also, bags tend to take on irregular shapes (depending on how full they are, etc.) which makes storage of bags inefficient. A problem with transporting bags is that, despite a thorough rinsing of the containers, it is common for the cans and uncapped bottles to retain some amount of liquid which spills into the bag, and contributes to a sticky mess when emptying the bag at the store. Another problem with this method is that, in many instances, the bags (due to the mess) are often used only once and then discarded, which is wasteful. A further problem is the time it takes to remove the containers from the bag at the redemption facility. The cans and bottles are usually removed from the bag one or two at a time to minimize the mess. Also, the cans and bottles must be sorted by the store clerk, which also slows the process. This can be especially frustrating when many people are in line at a supermarket to return their empty containers.

In view of the problems recited, a need has existed for a better method and apparatus for storing and transporting beverage containers.

SUMMARY OF THE INVENTION

The invention is a container for storing and transporting a plurality of beverage containers and the like. The container includes a substantially frusto-pyramidal housing having four supporting walls and a top wall supported by the supporting walls, having at least one depressed chamber extending downwardly from the top wall, wherein the supporting walls of the container are arranged to telescopingly engage supporting walls of an identical container and the chamber nestles within a corresponding chamber of the identical container when the container is stacked upon the identical container and the identical container is empty of beverage containers.

A general object of the invention is to provide a lightweight, stackable container to facilitate the return of beverage containers to a supermarket or redemption center.

A secondary object of the invention is to provide a container for the storage and transport of beverage containers and the like which is reusable, thereby eliminating the waste of natural resources.

These and other features, advantages and objects of the present invention will be appreciated by those having ordinary skill in the art in view of the following specification, claims and appended drawings.

DETAILED DESCRIPTION OF THE INVENTION

Figure 1:
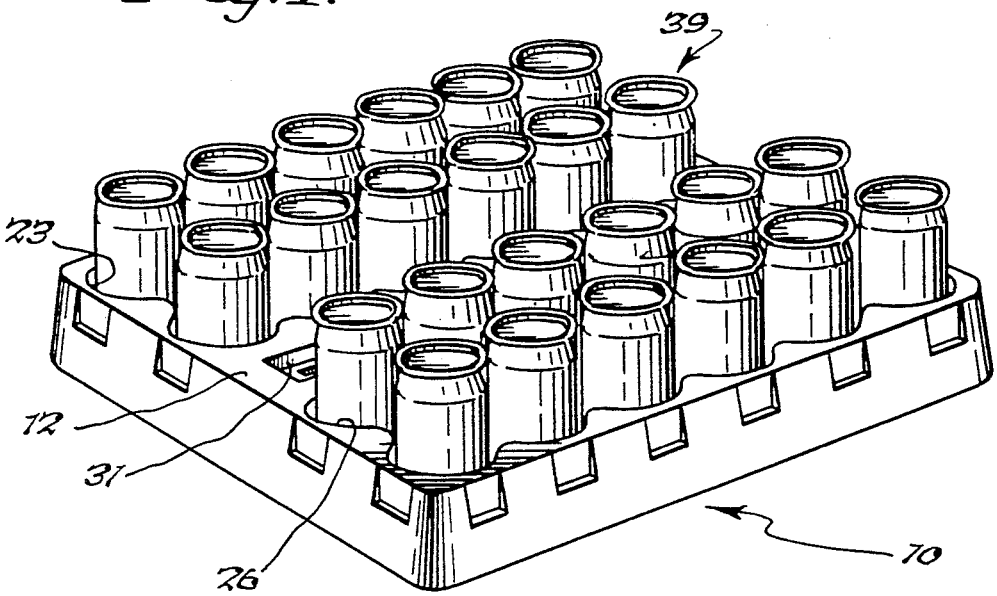
FIG. 1 is a perspective view of the container of the invention showing the container full of cans.

For purposes of the description which follows, the terms "upper", "lower", "left", "right", "front", "rear", "vertical", "horizontal", and derivatives thereof, refer to the invention as illustrated in the drawings from the perspective of a normal observer facing the drawings. At the outset, it should be understood that the word "container" is used throughout to describe the present invention, as distinct from the phrase "beverage container" which means the individual, separate sealed glass, metal, aluminum, steel or plastic bottle, can or jar used for containing a beverage intended for use or consumption by a person or animal. "Beverage" means carbonated soft drinks, mineral water, soda water, beer and other malt beverages, wine, liquor, non-carbonated flavored drinks, and fruit juice. "Malt beverages" means any beverage obtained by the alcoholic fermentation or infusion or decoction of barley, malt, hops, or other wholesome grain or cereal and water including, but not limited to ale, stout or malt liquor. Finally, although the present invention comprises a container for storing and/or transporting beverage containers, the container also includes means for being secured to other identical containers. Examples of stacked identical containers are shown in the drawings and described herein. To avoid confusion, since all of the individually stacked containers are identical, the same reference numerals are used to depict identical structural features on identical, albeit different, containers. However, "prime" reference numerals are used to depict features on the "identical" container, while "unprime" reference numerals are used to depict features on the "original" container.

What follows is a description of a preferred embodiment of the invention illustrating the best mode of the invention known to the patentees at the time of application. The claims are not intended to be limited in scope to the preferred embodiment described herein, but rather are intended to encompass variations thereof which are readily apparent to those having ordinary skill in the art. For example, although the preferred embodiment depicted is suitable for storing and/or transporting up to twenty four 12 oz. or 16 oz. cans, modified containers (having different dimensions) are envisioned which would carry a different number of cans as well as cans of different diameters. Similarly, the container is also suitable for carrying bottles and jars, and with minor structural changes, the bottle-containing container can be made stackable as well. Finally, the preferred embodiment depicts a container having two storage chambers, but it is readily imaginable that the containers can be modified to have a different number of storage chambers.

Adverting now to the drawings, FIG. 1 is a perspective view of container 10 holding twenty four substantially identical cans. The housing of container 10 is essentially frusto-conical in shape to facilitate stacking of identical containers when empty. Each of the four supporting walls extend downwardly from top wall 12. For simplicity, and because it is to be understood that all of the cans carried by the container are substantially the same, all individual cans are labeled with reference numeral 39.

The container is suitable for storing and/or transporting soft drink cans, beer cans, and the like. The container can carry the cans when full or empty. Due to the substantial weight of twenty four full cans, it is envisioned that a person would likely carry one, two or possibly three stacked containers of full cans at a time. When empty, however, it is conceivable that five, six or even more containers may be stacked and easily transported. A readily apparent advantage of the present invention is that supermarkets and redemption centers can stock the containers and, when consumers return their empty cans, the supermarket can simply give each consumer an empty container for each full container returned, expediting the return process.

Figure 2:
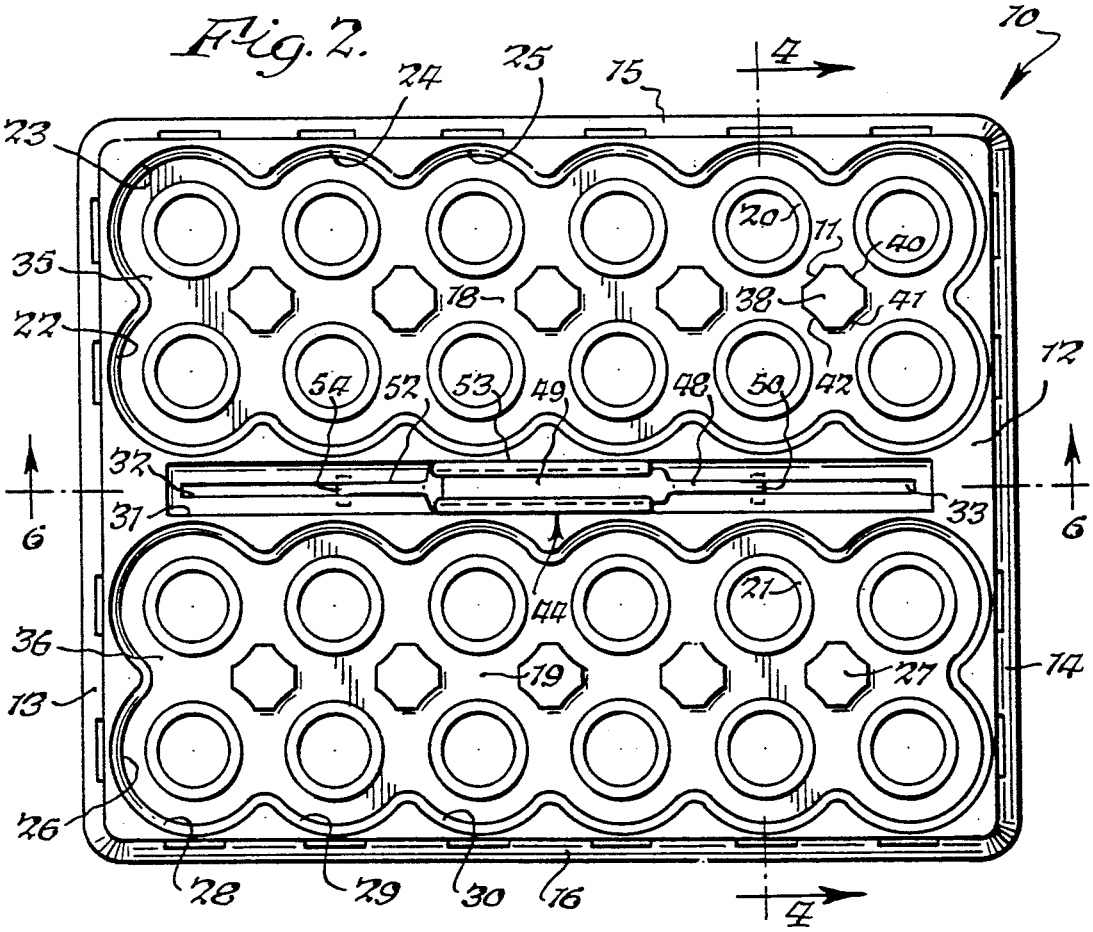
FIG. 2 is a top plan elevation of the container of FIG. 1, showing the container empty of cans.
Figures 3, 4, 5:
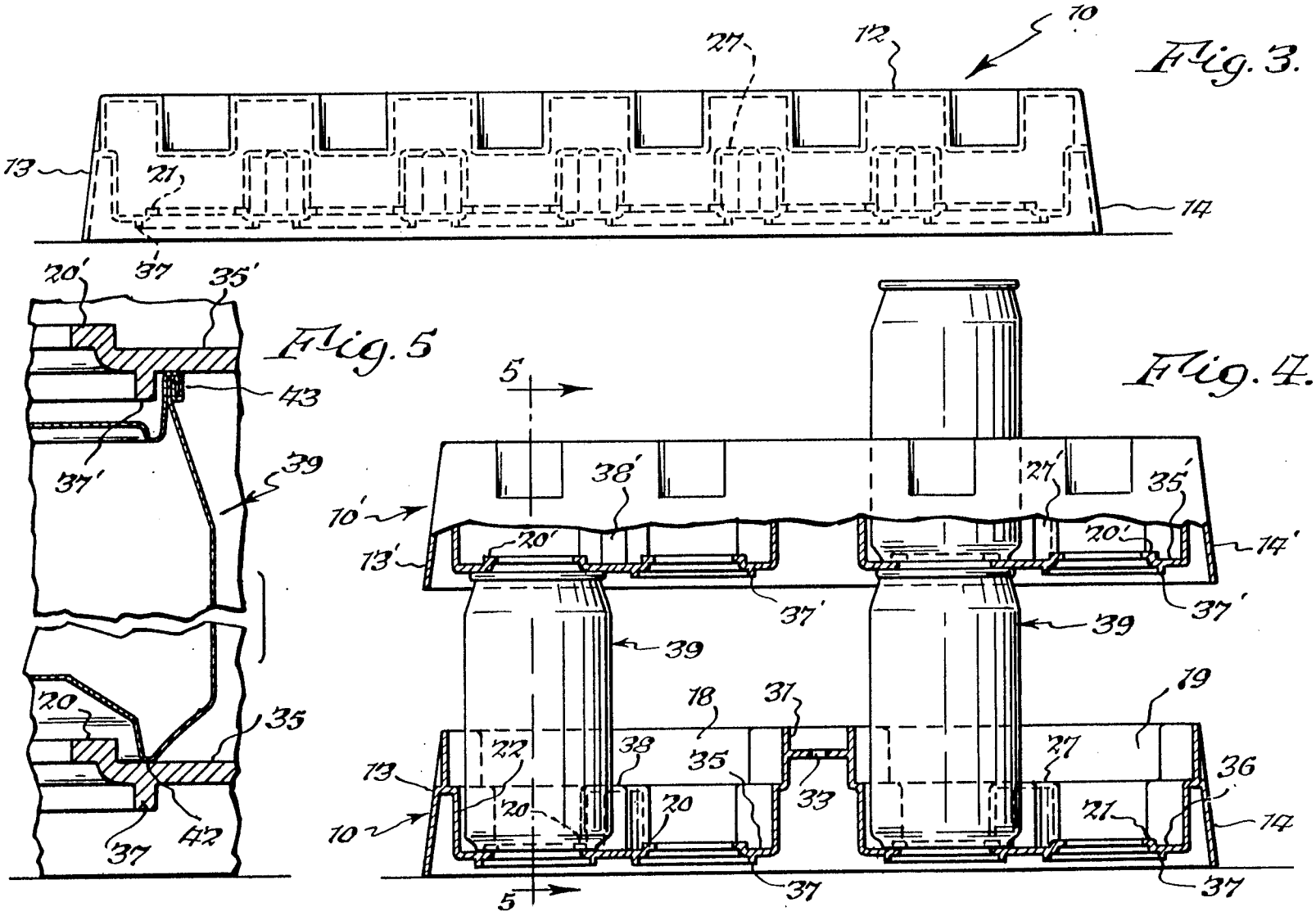
FIG. 3 is a side elevation of the container shown in FIG. 2.
FIG. 4 is an end elevation showing the container of FIG. 3 on the bottom, having two cans therein, and showing an identical container stacked thereon, with sections of both containers cut away, and is taken along line 4—4 of FIG. 2.
FIG. 5 is a vertical cross-section of the containers of FIG. 4 with sections cut away, taken generally at line 5—5 of FIG. 4.

FIG. 2 is a top plan elevation of the container of FIG. 1, showing the container empty of cans. Container 10 comprises top wall 12 which is supported by end walls 13 and 14 and side walls 15 and 16, respectively. Storage chambers 18 and 19 extend downwardly from top wall 12. Storage chamber 18 includes floor 35 (shown in FIG. 4), and is bounded by wall 22 which comprises twelve arcuate subsections, where each subsection partially surrounds a can to restrain the can from movement. For simplicity, only subsections 23, 24 and 25 have been labeled in FIG. 2. Each chamber includes twelve elevated annular rings which extend upwardly from the floor of the chamber, each of which fits inside the bottom section of a can to align the can in the container. Since all the annular rings are identical, only ring 20 in chamber 18 and ring 21 in chamber 19 have been labeled. Also extending upwardly from floor 35 are five identical octagonal posts, of which only post 38 is labeled. Each post includes four arcuate surfaces (e.g., post 38 includes four arcuate surfaces 11, 40, 41 and 42, respectively) which, in conjunction with the arcuate surfaces of wall 22, function to further restrain the cans within the chamber. Similarly, storage chamber 19 includes floor 36 (shown in FIG. 4), and is bounded by wall 26 which comprises twelve arcuate subsections, where each subsection partially surrounds a can to restrain the can from movement. For simplicity, only subsections 28, 29 and 30 are labeled in FIG. 2. Chamber 19 also includes five identical octagonal posts 27 arising from floor 36, and each post includes four arcuate surfaces which function in conjunction with the arcuate surfaces of wall 26 to align and restrain the cans in the chamber. FIG. 3 is a side elevation of the container shown in FIG. 2, which shows the five posts in dotted lines.

Also shown in FIG. 2 is rectangular trough 31, which includes slots 32 and 33. Individual sections of handle 44 slidingly and lockingly engage slots 32 and 33, as will be described infra.

FIG. 4 is a cross-sectional view with a part in elevation showing the container of FIG. 3 on the bottom, having two cans therein, and showing an identical container 10' stacked thereon, with sections of both containers cut away. The containers are partially cut away to show how the cans are aligned and fit into the container. For example, it is seen that the bottom rim of can 39 overlaps and fits securely about elevated annular ring 20. The can is further restrained by the arcuate surfaces of wall 22 and octagonal post 38.

As best seen in FIG. 5, which is a vertical cross-section of the containers of FIG. 4 with sections cut away (taken generally at line 5—5 of FIG. 4), can 39 is further restrained by lower annular ring 37' which descends from floor 35'. As seen in cross-section, can 39 includes lower circular rim 42 and upper circular rim 43. On most beverage cans, the diameter of the upper rim is slightly larger than the diameter of the lower rim. For this reason, the diameter of lower annular ring 37' is slightly larger than the diameter of upper annular ring 20. As shown in FIG. 5 lower rim 42 surrounds annular ring 20 and upper rim 43 surrounds annular ring 37'. Although some space is provided between the respective rings and rims to accommodate cans of different diameters, the rings function to align and prevent movement of the cans when two or more containers are stacked.

Figures 6, 7, 8, 9:
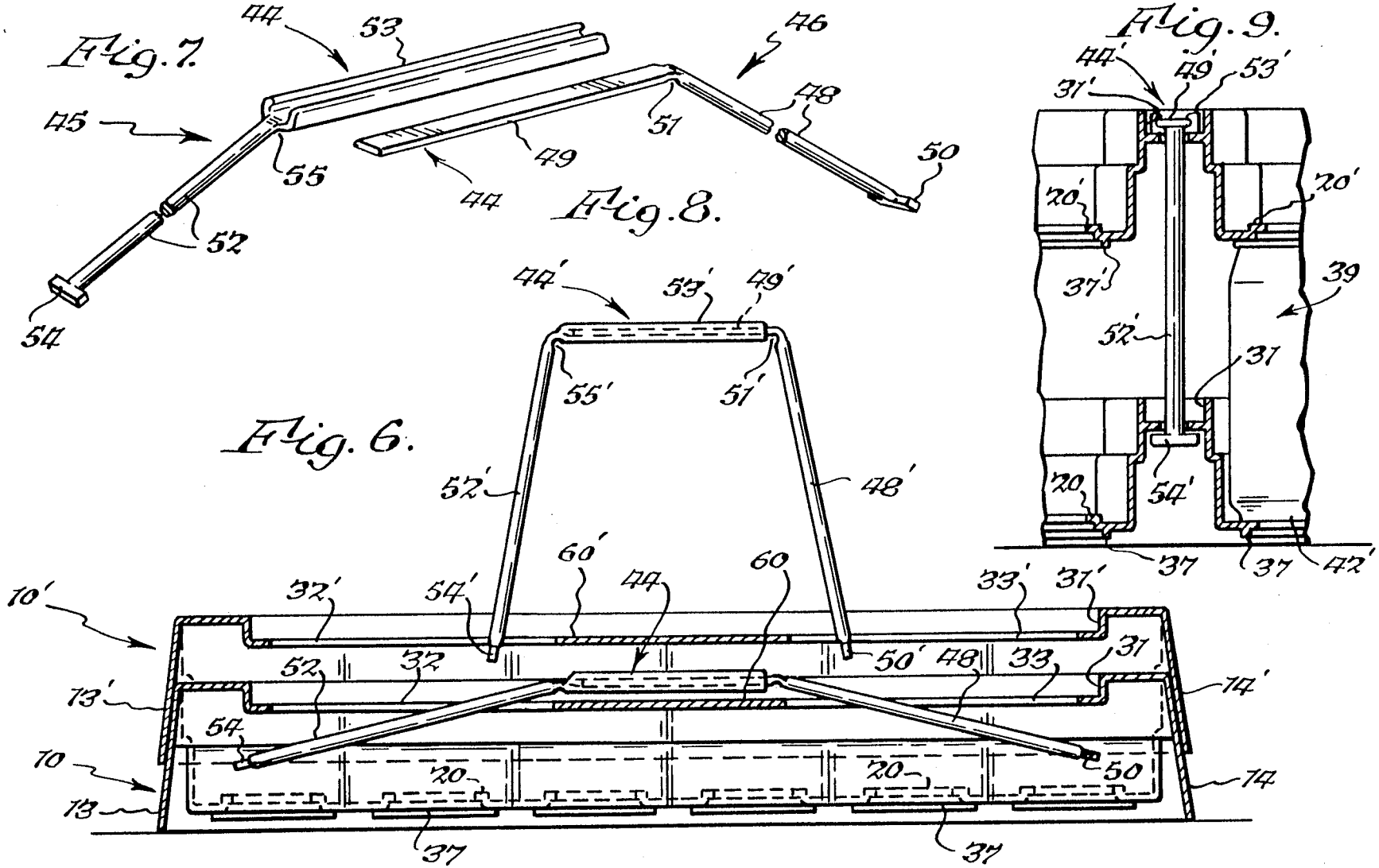
FIG. 6 is a longitudinal section of two identical empty containers of the invention, stacked one atop the other, and is taken along line 6—6 of FIG. 2.
FIG. 7 illustrates the bifurcated female section of the handle of the invention.
FIG. 8 illustrates the bifurcated male section of the handle of the invention.
FIG. 9 is a vertical fragmentary cross-section of the containers of FIG. 10, taken generally at line 9—9 of FIG. 10, and illustrating how the handle of the container also functions to secure two containers together when stacked.

The container includes a handle which functions both as a means of carrying one or more containers and also as a means of securing one container to another identical container. Handle 44 is depicted in FIGS. 7 and 8, and comprises male section 46 and female section 45. Male section 46 is bifurcated and includes first male section 48 and second male section 49. First male section 48 includes tab 50 which slidingly and lockingly engages slot 33. First male section 48 has a circular cross section so that it will pass through slot 33. Section 49 is somewhat rigid and is joined to section 48 at flexible junction 51, enabling section 49 to bend relative to section 48. Similarly, female section 45 is bifurcated and includes first female section 52 and second female section 53. First female section 52 includes tab 54 which slidingly and lockingly engages slot 32. First female section 52 has a circular cross-section so that it will pass through slot 32. Section 52 is somewhat rigid and is joined to section 53 at flexible junction 55, enabling section 52 to bend relative to section 53. Second male section 49 snaps into and lockingly engages second female section 53 to form handle 44.

Container 10' is shown in FIG. 6 as stacked atop identical container 10. As shown in the drawing, the frusto-pyramidal shape of the housing of container 10' facilitates stacking atop identical container 10. For example, wall 13' overlaps wall 13 and wall 14' overlaps wall 14, etc. Although the frusto-pyramidal shape facilitates stacking empty containers, it also provides stability for stacking a plurality of containers. It should be noted, however, that the chambers of one container nestle within corresponding chambers in an identical container when stacked empty, which also provides stability for stacking a plurality of containers. Although a preferred embodiment is shown in the drawings, an alternative embodiment is contemplated where the walls of the housing do not extend downwardly past the bottoms of the storage chambers (e.g., as shown in the cut-away view of the top container of FIG. 4) and do not overlap one another when stacked (the walls need not be frusto-pyramidal in shape either). In other words, the container would be supported by the floor of the chamber only when resting on a flat surface (and would not be supported by the side and end walls) and, also, the stacked containers would be aligned only by the nestling of the chambers within each other (this nesting of the chambers is best shown in FIG. 6). This alternative embodiment would utilize less material and therefore be less expensive to manufacture.

FIG. 6 shows handle 44 protruding underneath slots 32 and 33, which is made possible by the bending of sections 45 and 46 at flexible junctions 55 and 51, respectively. Part of section 48 lies below slot 33 while part of section 48 lies above the slot. Similarly, part of section 52 lies below slot 32 while part of section 52 lies above the slot. Handle 44 rests above or on floor 60 of trough 31.

Also as shown in FIG. 6, handle 44' is in an extended position, with sections 52' and 48' relatively vertical, and with tabs 54' and 50' lockingly engaging slots 32 and 33, respectively. This would be the position of the handle if one were in the process of removing the top container from a stack of containers.

Figures 10, 11:
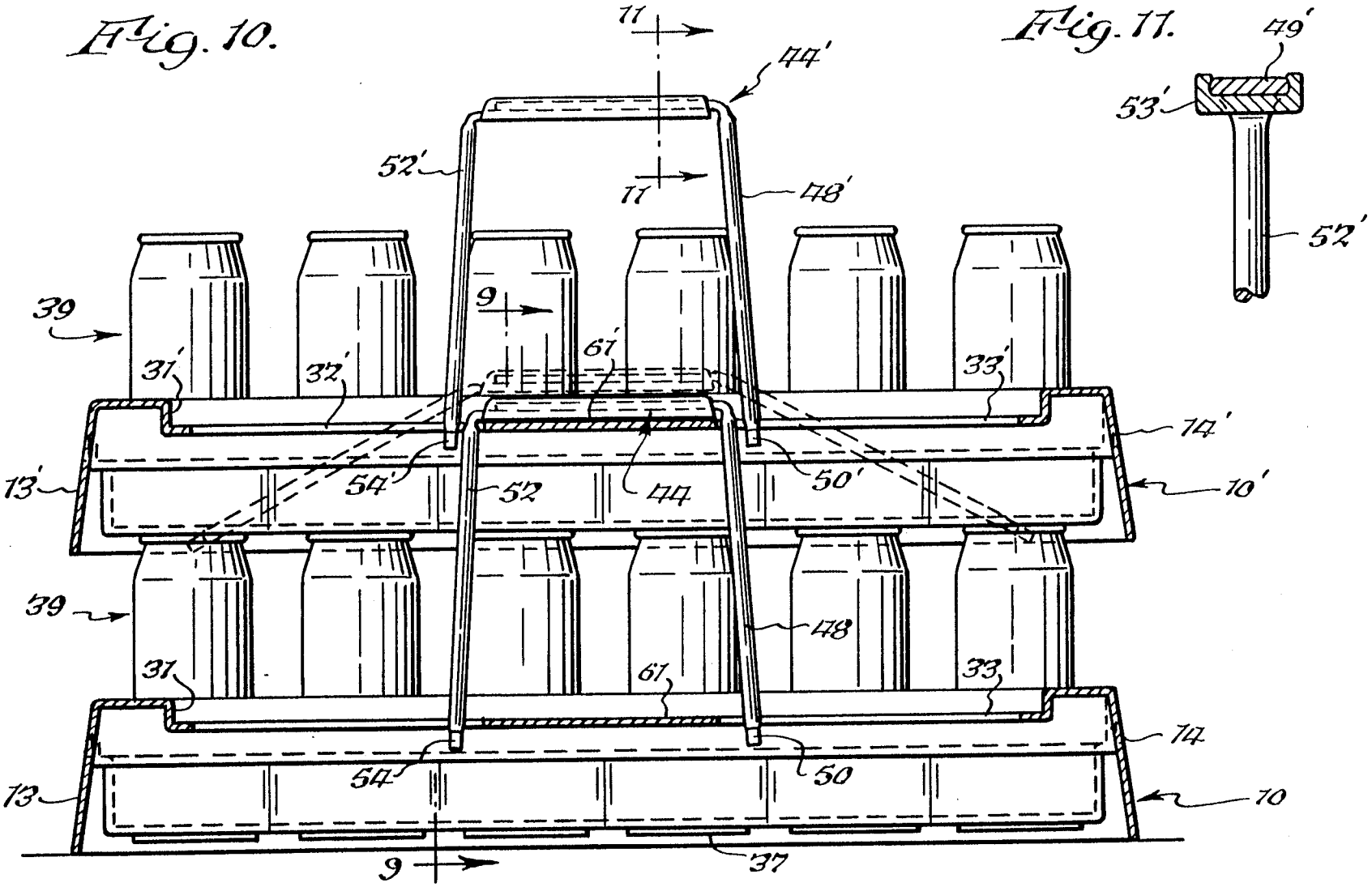
FIG. 10 is a longitudinal section of two identical full containers of the invention, stacked one atop the other, illustrating how the handle of the container also functions to secure two containers together when stacked.
FIG. 11 is an enlarged cross-sectional view of the joined male and female handle sections taken generally at line 11—11 of FIG. 10.

Adverting now to FIG. 10, container 10' is shown stacked atop identical container 10 and both containers are full of cans. The drawing is intended to illustrate the dual function of the container handle. Handle 44 functions to secure container 10 to container 10', while handle 44' is used to carry the pair of stacked containers. Although only two containers are shown in FIG. 10, it should be readily apparent that handle 44' could be used to secure yet another container above the two shown, and so on.

FIG. 9 is a vertical fragmentary cross-section of the containers of FIG. 10, taken generally at line 9—9 of FIG. 10, and illustrating how the handle of the container also functions to secure two containers together when stacked. As shown in the drawing, tab 54' of handle 44' is occluded by the slot within trough 31, and thus lockingly engages the lower container. Similarly, male section 49' and female section 53' lockingly engage to form handle 44' which rests on top of the floor of trough 31'. The handle is neatly tucked into trough 31' to prevent interference with yet another container to be stacked atop. It should be noted that, although the preferred embodiment includes a trough having a slot therein, any suitable opening in the top wall of the container would suffice for the same purpose. Thus, the containers are prevented from moving apart from one another, and are kept in a stacked arrangement for easy transport.

Figure 13:
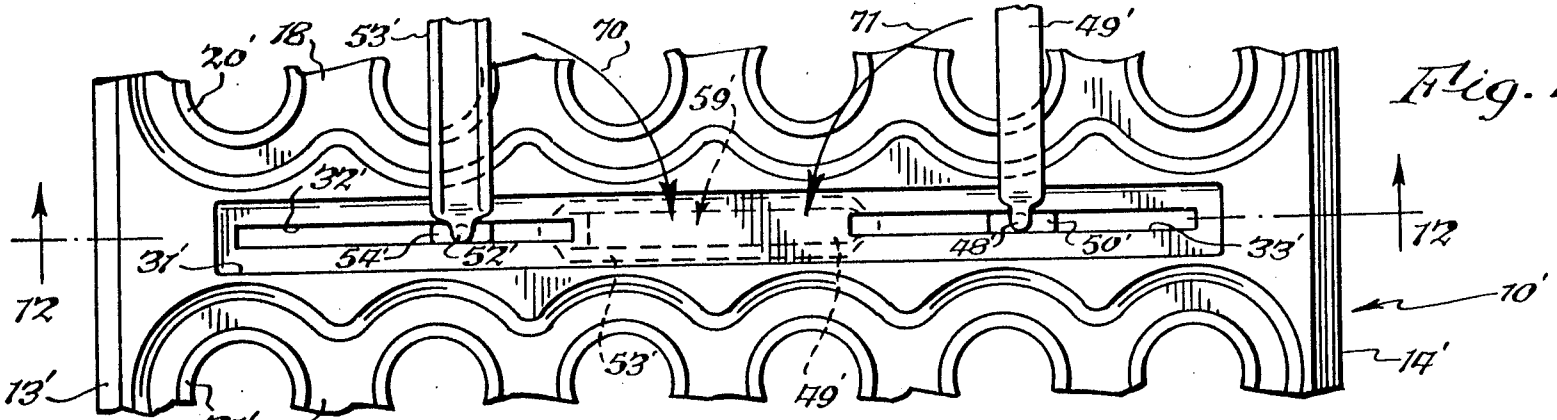
FIG. 13 is a top plan elevation of the container, with sections cut away, illustrating how the individual handle sections may be rotated in their respective slots and then joined together.
Figure 12:
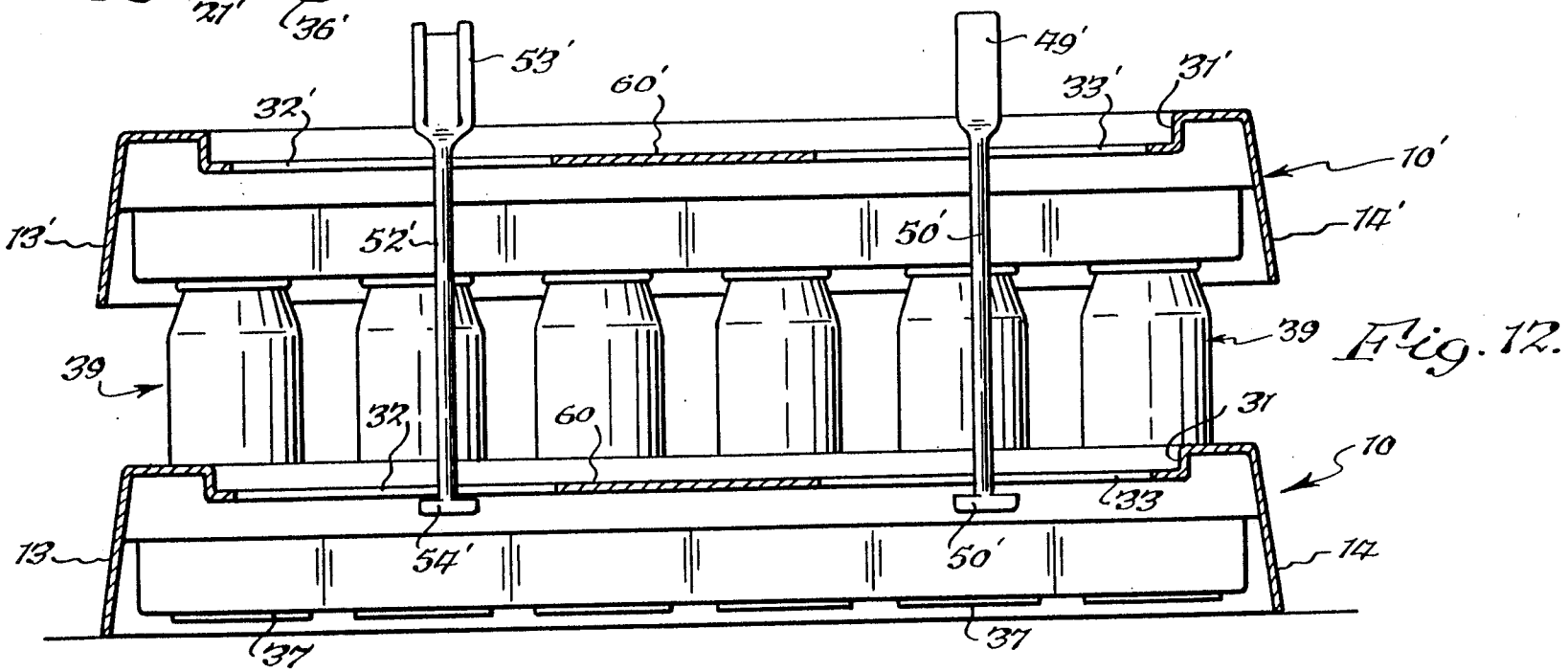
FIG. 12 is a view similar to that of FIG. 10, with the male and female handle sections rotated 90° in the slots of the respective containers, taken generally at line 12—12 of FIG. 13.

As can readily be seen in FIGS. 13 and 14, to position the handle sections 45' and 46' to carry a lower container filled with empty cans 39, each handle section is rotated to position their tabs 50' and 54' in alignment with slots 32' and 33', respectively, and are then projected downwardly through slots 32' and 33' of the top container, and then through slots 32 and 33 of the bottom container. Sections 45' and 46' are then individually rotated horizontally counter-clockwise and clockwise, respectively, as indicated by arrows 70, 71 into the dotted line position where the male section 49' is positioned above the female section 53'. Handlegrip 59' is then formed by pressing section 49' into gripping relationship with section 53', which is shown in cross-section in FIG. 11.

It will thus be seen that the objects set forth above, among those made apparent from the preceding description, are efficiently obtained. Since certain changes may be made in carrying out the above invention and in the construction set forth without departing from the scope of the invention, it is intended that all matter contained in the above description or shown in the accompanying drawings be interpreted as illustrative and not in a limiting sense. It is also to be understood that the following claims are intended to cover all of the generic and specific features of the invention herein described, and all statements of the scope of the invention, which, as a matter of language, might be said to fall therebetween.

What is claimed is:

1. A container for storing and transporting a plurality of beverage containers and the like, comprising a substantially frusto-pyramidal housing having four supporting walls and a top wall supported by said walls, said housing having at least one storage chamber extending downwardly from said top wall, wherein said supporting walls of said container are arranged to telescopingly engage supporting walls of an identical container and said chamber nestles within a corresponding chamber of said identical container when said identical container is empty of said beverage containers, said storage chamber having a floor having a plurality of elevated annular rings arising upwardly therefrom, said annular rings arranged to receive and position said beverage containers and the like within said chamber, said floor also having a plurality of annular rings extending downwardly therefrom to align and position tops of beverage containers within said identical container stacked therebelow, said annular rings having an external diameter that is less than the external diameter of said beverage containers, wherein said housing further includes means for securing said container to said identical container when said identical container contains one or more of said beverage containers.

2. A container for storing and transporting a plurality of beverage containers and the like, comprising a substantially frusto-pyramidal housing having four supporting walls and a top wall supported by said walls, said housing having at least one storage chamber extending downwardly from said top wall, wherein said supporting walls of said container are arranged to telescopingly engage supporting walls of an identical container and said chamber nestles within a corresponding chamber of said identical container when said identical container is empty of said beverage containers, said storage chamber having a floor having a plurality of elevated annular rings arising upwardly therefrom, said annular rings arranged to receive and position said beverage containers and the like within said chamber, said floor also having a plurality of annular rings extending downwardly therefrom to align and position tops of beverage containers within said identical container stacked therebelow, said annular rings having an external diameter that is less than the external diameter of said beverage containers, wherein said housing further includes means for securing said container to said identical container when said identical container contains one or more of said beverage containers, wherein said means for securing comprises a two-piece handle having a male section and a female section, each of which sections are secured to said housing and are arranged to extend through an opening in a housing of another container where the male and female sections may be joined at a position over approximately the center of joined-together containers to accommodate the lifting of said joined-together containers by a single hand.

3. A container for storing and transporting a plurality of beverage containers and the like, comprising a substantially frusto-pyramidal housing having four supporting walls and a top wall supported by said walls, said housing having at least one storage chamber extending downwardly from said top wall, wherein said supporting walls of said container are arranged to telescopingly engage supporting walls of an identical container and said chamber nestles within a corresponding chamber of said identical container when said identical container is empty of said beverage containers, said storage chamber having a floor having a plurality of elevated annular rings arising upwardly therefrom, said annular rings arranged to receive and position said beverage containers and the like within said chamber, said floor also having a plurality of annular rings extending downwardly therefrom to align and position tops of beverage containers within said identical container stacked therebelow, said annular rings having an external diameter that is less than the external diameter of said beverage containers, wherein said housing further includes means for securing said container to said identical container when said identical container contains one or more of said beverage containers wherein said means for securing comprises:

an opening in said top wall;

a male bifurcated handle section having a first section and a second section, wherein said male first section is adapted to pass through said opening and pass through a corresponding opening and lockingly engage a corresponding top wall of said identical container; and a female bifurcated handle section having a first section and a second section, wherein said female first section is adapted to pass through said opening and pass through a corresponding opening and lockingly engage a corresponding top wall of said identical container;

wherein said male second section and said female second section are adapted to lockingly engage one another to secure said container to said identical container and also to form a single handle to facilitate lifting of said containers.

* * * * *